US008497441B2

(12) United States Patent
Yoshihiro

(10) Patent No.: US 8,497,441 B2
(45) Date of Patent: Jul. 30, 2013

(54) LUMINOUS SWITCH AND ELECTRONIC DEVICE PROVIDED WITH THE SAME

(75) Inventor: Takaaki Yoshihiro, Tokyo (JP)

(73) Assignee: NEC Corporation, Tokyo (JP)

( * ) Notice: Subject to any disclaimer, the term of this patent is extended or adjusted under 35 U.S.C. 154(b) by 206 days.

(21) Appl. No.: 13/102,524

(22) Filed: May 6, 2011

(65) Prior Publication Data

US 2011/0209973 A1 Sep. 1, 2011

Related U.S. Application Data

(63) Continuation of application No. 12/279,216, filed as application No. PCT/JP2007/052904 on Feb. 13, 2007, now Pat. No. 7,960,663.

(30) Foreign Application Priority Data

Feb. 13, 2006 (JP) ..... 2006-035859

(51) Int. Cl.
*H01H 13/83* (2006.01)

(52) U.S. Cl.
USPC ..... 200/314; 200/5 A; 200/516

(58) Field of Classification Search
USPC .... 200/406, 516, 310–317, 341, 5 A; 341/22, 341/23, 28, 34; 345/168–170
See application file for complete search history.

(56) References Cited

U.S. PATENT DOCUMENTS 6,806,815 B1 * 10/2004 Kaikuranta et al. ..... 341/22
7,094,985 B2 * 8/2006 Kobayashi et al. ..... 200/516
7,194,085 B2 * 3/2007 Yamazaki et al. ..... 379/433.07
7,260,888 B2 * 8/2007 Hsu et al. ..... 29/622
7,619,176 B2 * 11/2009 Yoshihiro ..... 200/516
7,777,726 B2 * 8/2010 Sato et al. ..... 345/173

(Continued)

FOREIGN PATENT DOCUMENTS

CN 1669102 A 9/2005
EP 1 035 557 A2 9/2000

(Continued)

OTHER PUBLICATIONS

European Search Report issued Sep. 14, 2011 in counterpart European Application No. 07714431.9.

*Primary Examiner* — Renee Luebke
(74) *Attorney, Agent, or Firm* — Sughrue Mion, PLLC

(57) ABSTRACT

A luminous switch using an inorganic EL material is provided with a plurality of switch sections so as to reduce acoustic noise. The switch sections are provided with a plurality of protruding parts (112) and a plurality of supporting sections (113) formed on a surface of a structure (101); an elastic deformable conductor (124) arranged to have a convex surface opposed the protruding parts (112); a wiring sheet (102A) for covering the conductor (124); a luminous sheet (160) for covering the wiring sheet (102A); and a plurality of switch buttons (125) arranged above the luminous sheet (160). The luminous switch has a structure in which at least two supporting sections (113) are arranged around the protruding parts (112), and a space (111) is formed between the protruding parts (112) and a switch sheet (102). The conductor (124) is accommodated in the space (111). In a case main body (101), an electronic component (103) is mounted and a substrate (104) provided with wiring is arranged. The switch buttons (125) are fixed on a key sheet (129). A top plate (106) is arranged on the key sheet (129) by surrounding the switch buttons (125). The top plate (106) is arranged to cover lower components.

15 Claims, 13 Drawing Sheets

U.S. PATENT DOCUMENTS

| | | | | |
|---|---|---|---|---|
| 7,960,663 | B2 * | 6/2011 | Yoshihiro | 200/310 |
| 2002/0030987 | A1 | 3/2002 | Saito et al. | |
| 2006/0042923 | A1 | 3/2006 | De Richecour et al. | |
| 2006/0066539 | A1 * | 3/2006 | Kato | 345/77 |
| 2008/0093961 | A1 * | 4/2008 | Koyano et al. | 313/11 |

FOREIGN PATENT DOCUMENTS

| | | | |
|---|---|---|---|
| JP | 2002-23921 | A | 1/2002 |
| JP | 2002-216570 | A | 8/2002 |
| JP | 2004-96057 | A | 3/2004 |
| JP | 2005-085582 | A | 3/2005 |

* cited by examiner

COMPARISON OF CLICK SOUND WHEN THERE ARE SUPPORTING SECTIONS AND WHEN THERE ARE NONE

LUMINOUS SWITCH AND ELECTRONIC DEVICE PROVIDED WITH THE SAME

This application is a continuation of application Ser. No. 12/279,216 filed Aug. 13, 2008 which is a 371 National Stage Entry of PCT/JP2007/052904, filed Feb. 13, 2007 which claims priority under 35 U.S.C. §119 from Japanese Patent Application No. 2006-035859 filed on Feb. 13, 2006. The entire disclosures of the prior applications, application Ser. Nos. 12/279,216, PCT/JP2007/052904 and JP 2006-035859 are considered part of the disclosure of the accompanying continuation application and are hereby incorporated by reference.

TECHNICAL FIELD

The present invention relates to an illumination structure for key switches constituting an operation system of a mobile terminal, and more particularly, to an illumination structure which realizes thinning and uniform illumination, and an electronic device provided with the same.

BACKGROUND ART

In a mobile terminal such as a mobile phone, a personal handy phone system (PHS), and a personal digital assistant (PDA), a tendency toward downsizing and thinning is being accelerated. In order to achieve the downsizing and thinning of such mobile terminals described above, development has been promoted about downsizing and thinning of functional components for forming the same, thinning of a printed circuit board on which the functional components are mounted, downsizing of an antenna system, a reduction in wall thickness and thinning of a casing accommodating the functional components, the printed circuit board, etc., and the like. Under the circumstances, the thinning of a switch structure is also being promoted. However, it should be noted that the thinning tends to impair uniformity of switch illumination.

FIGS. 21 and 22 are sectional views of conventional mobile terminals. In particular, the conventional mobile terminal as shown in FIG. 22 is generally formed by stacking, in a thickness direction, a structure 501, switch buttons 525, a key sheet 502, conductors 524, a switch substrate 555, and a substrate 504 on which electronic components 503 are mounted. A predetermined number of LEDs 560 are mounted on the switch substrate 555, and emit light horizontally or vertically. The switch substrate 555 should be arranged on a flat plane, and the LEDs 560 should be situated outside of the conductors 524.

The structure 501 has a large number of through-holes, through which the switch buttons 525 are projected. Wiring patterns 522A and 522B are formed on an upper surface of the switch substrate 555. The conductors 524 are formed by a conductive material elastically deformable and have outer peripheral edges electrically connected to the wiring pattern 522A. When the switch buttons 525 are depressed, the conductors 524 are caused to undergo elastic deformation via the key sheet 502, and the central portions thereof come into contact with the wiring pattern 522B. As a result, the wiring patterns 522A and 522B become electrically conductive with each other. This makes it possible to input predetermined information. The LEDs 560 are caused to emit light with timing with which the predetermined information is input. The light from the LEDs 560 passes peripheral clearances, and is scattered from a horizontal direction to a vertical direction to be output through the key sheet and the switch buttons.

Next, FIG. 21 shows a structure 101 as disclosed in Patent Document 1 (JP 2002-23921 A). The structure 101 has protrusions 112 provided on an upper surface, a surface-emission type luminous sheet 160 placed on a wiring sheet on which conductors 124 are mounted and downwardly directed toward the protrusions 112. Surface light emission is effected by an organic EL fluorescent material (OLED). Solely the plurality of protrusions 112 are arranged on the structure 101, and no members supporting the wiring sheet are provided around the protrusions 112. Further, this structure is featured by an illumination region separate from the wiring pattern on the wiring sheet. When the switch buttons 125 are depressed, the switch buttons 125 push down the conductors 124, and denting click operation is effected with the protrusions 112, thereby operating the switch circuit. Description in Patent Document 1 is restricted to the illuminating function, and nothing is disclosed therein regarding switch click characteristics involved and an influence of the illumination on the periphery.

DISCLOSURE OF THE INVENTION

Problem to be Solved by the Invention

As described in Patent Document 1, when an organic EL fluorescent material (OLED) is used for a luminous switch section, a pressing force applied at a time of switch depression (e.g., force due to key pressing) is a pressure applied to a light emitting surface, and this pressure may physically destroy a fluorescent member. In this regard, an inorganic EL fluorescent material, which is formed from rare-earth elements (minerals or the like) such as Zn and S, is resistant to external forces. Thus, by adopting a luminous sheet using an inorganic EL fluorescent material in the switch section, it is possible to realize a switch resistant to pressures applied to the light emission surface.

However, it has been found out that, when adopting a luminous sheet using an inorganic EL material, the luminous switch structure of the configuration as disclosed in Patent Document 1 is large in acoustic noise. When the inorganic EL material is used, the light emission is effected through AC voltage driving. At this time, it has been clarified that a fine oscillation in a thickness direction of a sheet is generated by an electric field applied to the inorganic EL material, resulting in generation of acoustic noise.

It is an object of the present invention to provide, based on the above-mentioned findings, a switch structure in which the acoustic noise generated at a time of switch depression is reduced, and which helps to achieve an improvement in terms of illumination visibility.

Means to Solve the Problem

A luminous switch of the present invention includes: a wiring sheet having wiring on a surface thereof; an elastic member electrically conductive to the wiring of the wiring sheet; a structure equipped with a plurality of supporting sections for supporting the wiring sheet; and a luminous sheet effecting surface light emission on a back surface of the wiring sheet by means of an inorganic EL material, and is characterized in that the supporting sections are arranged at positions of reducing acoustic noise generated by the luminous sheet, and characterized in that an interval (inner dimension) between the plurality of supporting sections is larger than a width of the elastic member in both longitudinal and lateral directions.

Further, a luminous switch of the present invention is characterized in that an electrode is formed on the wiring sheet, and characterized in that the electrode is situated so as to be electrically connected to the elastic member at a time of deformation of the elastic member.

Further, a luminous switch of the present invention is characterized in that the wiring sheet has a notch or a slit around the wiring.

Further, a luminous switch of the present invention is characterized in that the elastic member is held between the wiring sheet and a cover sheet.

Further, a luminous switch of the present invention is characterized in that the cover sheet has an adhesive on a surface thereof which holds the elastic member.

Further, a luminous switch of the present invention is characterized in that the luminous sheet has a protective layer, and characterized in that, in a light emission region outer peripheral portion of the protective layer, a thickness of the portion of the protective layer constituting at least a part of the light emission region outer peripheral portion is smaller than a thickness of the light emission region.

Further, a luminous switch of the present invention is characterized in that a switch button is provided on a side opposite to a surface of the luminous sheet having the wiring sheet.

Further, a luminous switch of the present invention is characterized in that a top plate covering the luminous sheet is provided on the side opposite to the surface of the luminous sheet having the wiring sheet.

Further, a luminous switch of the present invention is characterized in that the supporting sections are arranged so as to support the wiring sheet in an outer peripheral region of a region of the wiring sheet where the switch button is arranged.

Further, a luminous switch of the present invention is characterized in that the structure has a space formed by the supporting sections so as to accommodate the elastic member, and characterized in that a protruding part is formed in the space.

Further, a luminous switch of the present invention is characterized in that the structure is a casing.

Further, a luminous switch of the present invention is characterized in that the casing is formed of sheet metal.

Further, according to the present invention, an electronic device having a luminous switch described above is provided.

Effect of the Invention

In the luminous switch of the present invention, the supporting sections are formed in the form of dot-like members, that is, the interval (inner dimension) between the supporting sections is larger than the width of the elastic member in both the longitudinal and lateral directions. With this structure, it is possible to reduce the acoustic noise due to the inorganic EL illumination. Further, due to the provision of the supporting sections, the frequency band is shifted so as to achieve an increase in natural frequency, making the acoustic noise almost inaudible to the human ear.

BEST MODE FOR CARRYING OUT THE INVENTION

Next, embodiments of the present invention are described in detail with reference to the drawings.

First Embodiment

Figure 1:
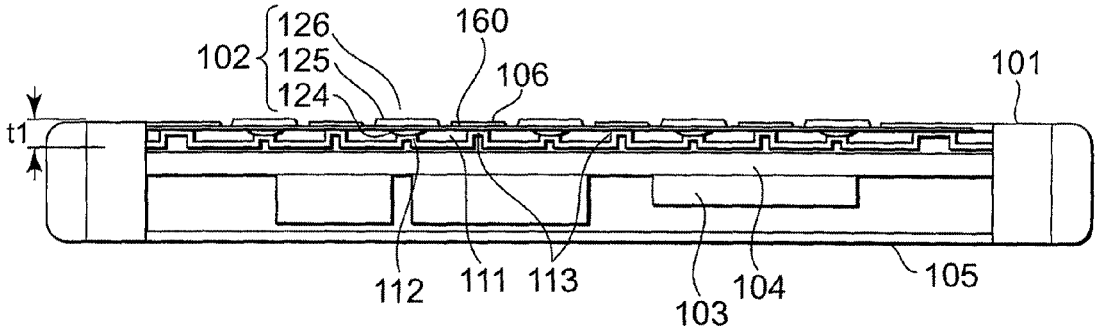
FIG. 1 is a sectional view of an electronic device showing a luminous switch according to a first embodiment of the present invention.
Figure 2:
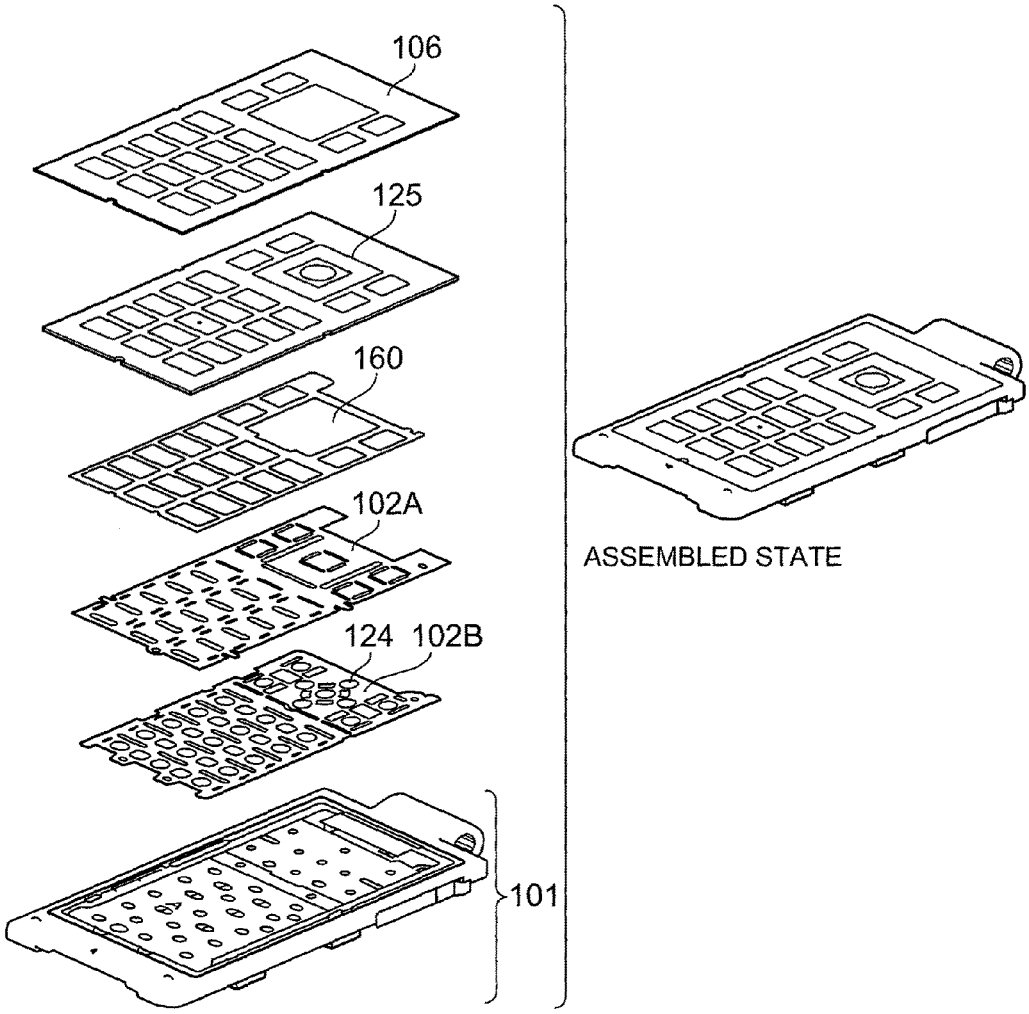
FIG. 2 is an exploded perspective view of a luminous switch according to the first embodiment of the present invention.
Figure 3:
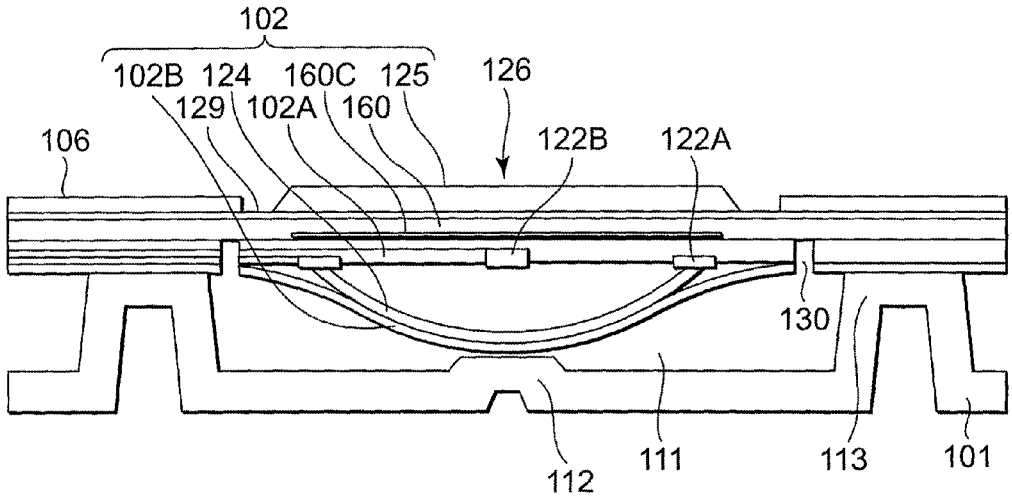
FIG. 3 is a sectional view of one of the switches of the luminous switch according to the first embodiment of the present invention.
Figure 4:
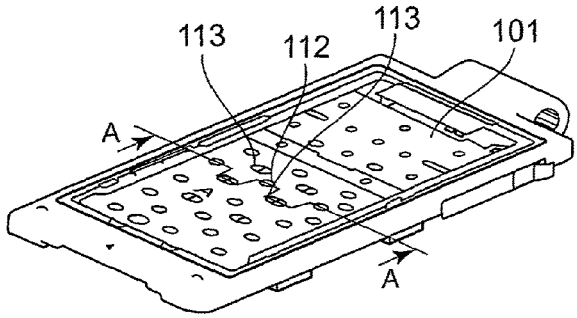
FIG. 4 is a perspective view of a structure showing an inorganic EL luminous switch according to the first embodiment of the present invention.

FIG. 1 is a sectional view of a luminous switch according to an embodiment of the present invention. FIG. 2 is an exploded perspective view of the luminous switch, and FIG. 3 is a sectional view of one pushbutton switch of the luminous switch.

As shown in FIGS. 1 and 2, the luminous switch of the present invention has a plurality of protruding parts 112 and a plurality of supporting sections 113 both of which are formed on a surface of a structure 101. Further, as is apparent from FIG. 3, which is a sectional view of a switch section of FIG. 1, a plurality of switch sections each include a conductor 124 which is elastically deformable and which is arranged so that its convex surface is opposed to the protruding part 112, a wiring sheet 102A covering each conductor 124, a luminous sheet 160 covering the wiring sheet 102A, and a plurality of switch buttons 125 arranged above the luminous sheet 160.

At least two supporting sections 113 are provided around each protruding part 112, and have a space 111 formed between the protruding parts 112 and the switch sheet 102. Each conductor 124 is accommodated in the space 111. Inside the case main body 101, there is arranged a substrate 104 on which an electronic component 103 is mounted and on which wiring is arranged.

The switch buttons 125 are fixed onto a key sheet 129. A top plate 106 surrounds the switch buttons 125 and is arranged on the key sheet 129. The top plate 106 is arranged so as to cover the components placed under the top plate 106.

The switch sheet 102 shown in FIG. 3 is a composite sheet formed by stacking together the luminous sheet 160, the wiring sheet 102A, the conductor 124, a cover sheet 1028, etc. The switch buttons 125 are mounted on the switch sheet 102. The conductor 124 is held by the cover sheet 102B which exhibits adhesiveness on a part or all of the surface thereof, and is substantially arranged at the same position as wiring patterns 122A and 1228 of the wiring sheet 102A, with the convex portions thereof being directed toward the protruding parts 112. Further, the conductor 124 is held or grasped by the cover sheet 1028 so that its positional relationship with the wiring patterns 122A and 122B in the horizontal direction is not deviated.

A plurality of conductors 124 are placed on the wiring sheet 102A, to realize the switch function of each switch button. Each of the conductors 124 may be elastically deformable and may realize electrical conduction between the wiring patterns 122A and 1228 at the time of elastic deformation. For example, the conductors 124 may be entirely formed of a conductor, or may have a base material which partially includes an elastically deformable portion effecting electrical conduction between the wiring patterns 122A and 1228.

The wiring sheet 102A is a flexible printed circuit (FPC) sheet, and has the wiring patterns (electrodes) 122A and 1228 on the surface opposite to the surface where the switch buttons 125 are arranged. The wiring patterns 122A and 122B are electrically connected to the electronic component 103 on the substrate of FIG. 1. The wiring patterns 122A are arranged around the wiring patterns 1228 in an annular shape. Here, the wiring patterns 122A may form lead-out wiring patterns leading the wiring patterns 1228 to the exterior of the areas where the wiring patterns 122A are formed, and hence the wiring patterns 122A may partially have cutouts. Further, the wiring patterns 1228 may not always be wirings but may simply be electrodes for electrical conduction of electric signals. While under the pressing force from the cover sheet 1028, the outer peripheral portions of the conductors 124 are in contact with the wiring patterns 122A, and, as a result, the conductors 124 and the wiring patterns 122A are electrically connected to each other. Here, the distance between the wiring patterns 1228 and the upper surfaces of the convex portions of the conductors 124 is approximately 0.2 mm and is sufficiently smaller than the diameter of the wiring patterns 122A. The wiring sheet 102A and the cover sheet 1028 are formed of elastic sheets.

Figure 6:
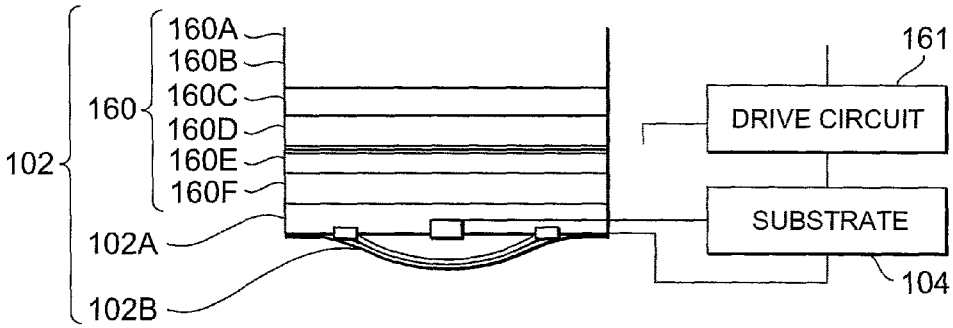
FIG. 6 is a schematic sectional view of a switch sheet of the luminous switch according to the present invention.

The luminous sheet 160 is a thin light source adapted to effect surface light emission by a fluorescent material (in particular, inorganic EL fluorescent material). As shown in FIG. 6, the luminous sheet 160 is basically formed by stacking, on a film substrate 160A, a transparent electrode 160B, an EL light emission layer (light emission layer formed of an inorganic EL material) 160C, a dielectric layer 160D, a back side electrode 160E, and a protective layer 160F. As the film substrate 160A, a transparent or translucent film is suitably used. The EL light emission layer 160C effects illumination toward the plane of the film substrate. As the materials of the layers formed on the film substrate 160A, relatively soft polymer type materials are suitable, and the layers can be produced, for example, by screen printing. From the viewpoint of securing the visibility of the switch buttons, it is desirable for the illumination regions to be substantially the same regions as the switch buttons. Instead of the illumination regions described above, the illumination region may be formed over the entire layer surface, or around the switch buttons. The light emitted from the luminous sheet 160 is visible to the naked eye through the switch buttons 125. Regarding the processing performed on the front surfaces and the back surfaces of the switch buttons 125, the density of the printed characters, the film thickness, etc. are optimized.

As shown in FIG. 1, the above structure is covered with a back casing 105, so as to prevent the electronic component 103 and the substrate 104 from exposure to the exterior. When the electronic component 103 and the substrate 104 are protected electrically and mechanically by some protective material, the back casing may be omitted.

Here, the arrangement of the supporting sections 113 is described with reference to FIG. 5. As shown in the one-direction sectional view of FIG. 5, the supporting sections 113 provided on the structure 101 are arranged at a predetermined pitch L1. In this drawing, three switch buttons are arranged in the lateral direction. When no supporting sections 113 are provided between the three switch buttons, the distance between both ends of the switch sheet 102 is L. The switch sheet 102 is mounted on the supporting sections 113, and the top plate 106 is mounted on the switch sheet 102.

Further, the configurations, dimensions, and layout of the supporting sections 113 and the protruding parts 112 will be described below. As seen from the switch button 125''' of FIG. 7, in the basic construction of the portion around each switch button 125, a plate for the switch button 125 is in one-to-one correspondence with one switch function. In this case, the supporting sections 113 are arranged at the four corners of the switch button 125'''. The configuration of the upper surfaces of the supporting sections 113 may be selected from among circular, elliptical, and polygonal configurations. In this example, the circular and elliptical configurations are selected. The end surfaces of the upper surfaces of the supporting sections are of a rounded configuration of a predetermined curvature. The protruding part 112 has a circular configuration, and the end surface of the upper surface thereof is of a rounded configuration of a predetermined curvature. In order that the contour of the protruding part 112 and the contour of the switch button 125''' may not overlap each other at least in one planar direction, a gap is provided.

The diameter and height of the protruding part 112 influence the click characteristics of the conductor 124 and, in particular, the click rate and the operational force thereof. Usually, the diameter of the protruding part 112 preferably is approximately 20% to 50% of the diameter of the conductor 124. In the case of the conductor 124 having a diameter of $\phi 4$ mm, the diameter of the protruding part 112 preferably ranges from $\phi 1.5$ to 2.0 mm and the height thereof ranges from 0.2 to 0.3 mm. The height of the supporting section 113 is set to be somewhat larger than that of the protruding part 112.

Here, the illumination and switch operation are described.

The switch operation is featured by a click operation performed by denting the convex portion of the conductor 124 toward the protruding part 112. In the following, the operation is specifically described with reference to FIG. 3. When the user depresses the switch button 125, then the luminous sheet 160, the wiring sheet 102, and the cover sheet 102B undergo elastic deformation, and the wiring pattern 122B is pushed down. At this time, the convex portion of the conductor 124 is pushed upwardly by the protruding part 112, and comes into contact with the wiring pattern 122B in the vertical direction. As a result, the wiring patterns 122A and 1228 become electrically conductive with each other via the conductor 124, and information indicating the depression of the switch is input to the electronic component 103 on the substrate 104. Here, the conductor 124 may not be constantly in contact with the wiring pattern 122B. Contacts may be performed between the wiring pattern 122A and the outer periphery of the conductor and between the wiring pattern 1228 and the inner periphery of the conductor when conduction is established due to depression of the switch button 125.

As shown in FIG. 6, the luminous sheet 160 emits light by applying a predetermined AC voltage to the transparent electrode 160B and the back side electrode 160E and by exciting the EL light emission layer 160C, which is a fluorescent member. The AC voltage is output from a drive circuit 161 to cause illumination to occur at a predetermined frequency. The timing with which the illumination is effected is as follows: when information indicating the depression of the switch button 125 is input to the electronic component 103, a predetermined signal is input from the electronic component 103 to the drive circuit 161 to effect illumination. The illumination operation may also be effected with some other timing in conformity with the operation by the user, independently of the depression of the switch button 125.

Next, the effects of the present invention are described. It has been found out that the luminous sheet 160 formed of an inorganic EL material generates a fine oscillation in the sheet thickness direction due to an electric field applied to the material through AC voltage driving, thereby generating acoustic noise. At this time, the acoustic noise sounds at a natural frequency of the luminous sheet 160. When both ends of the luminous sheet 160 are supported, the natural frequency of the luminous sheet 160 can be obtained from equation (1):

$$f0 = \frac{1}{2\pi}\sqrt{\frac{48EI}{mL^3}} \quad (1)$$

where E is the modulus of longitudinal elasticity; I, the geometrical moment of inertia; m, the mass; and L, the distance between the ends supported. The natural frequency $f_0$ is inversely proportional to the 3/2-th power of the distance L. Thus, by arranging the plurality of supporting sections 113 at proper intervals, it is possible to shift the natural frequency $f_0$ to a high-frequency zone. Further, by shortening the supporting distance, the amplitude of the oscillation of the luminous sheet 160 is also suppressed, thereby achieving a reduction in sound pressure.

Figure 5:
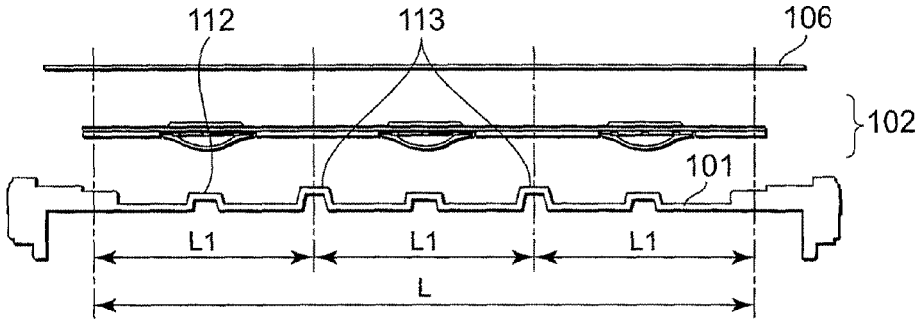
FIG. 5 is a sectional view of the structure of the luminous switch according to the first embodiment of the present invention.

More specifically, the distance L1 is set to 13.4 mm, which is ⅓ times the distance L of 40.2 mm when the two supporting sections 113 shown in FIG. 5 are absent. According to equation 1, the natural frequency $f_0$ is approximately five times.

Figure 16:
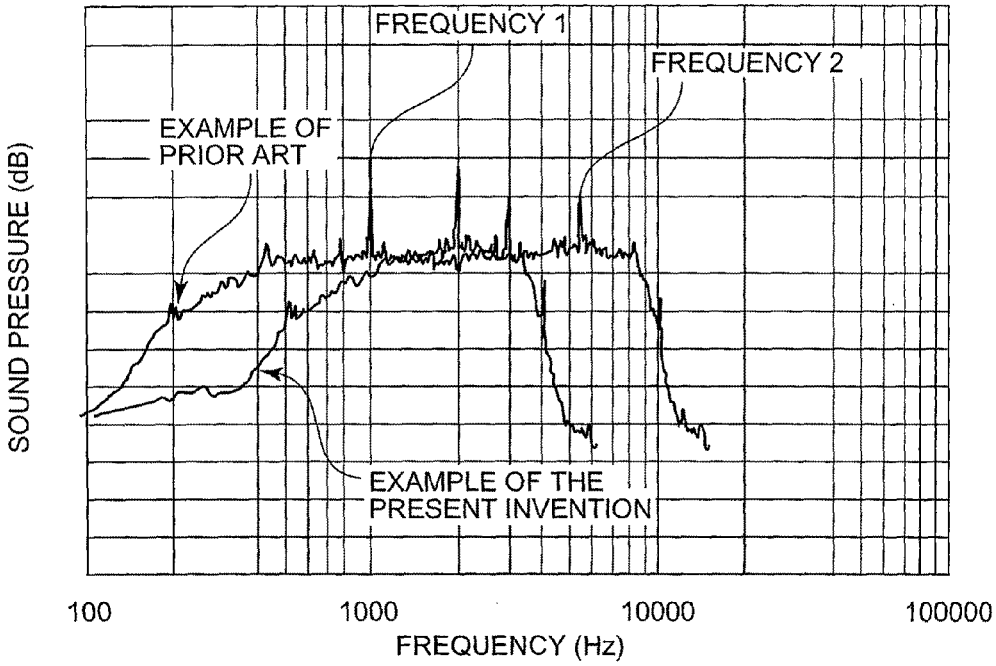
FIG. 16 is a graph showing acoustic characteristics of a luminous switch according to the present invention at the time of illumination.

FIG. 16 shows an example of the frequency characteristic of the acoustic noise emitted from the luminous sheet 160. In the conventional structure without supporting sections, within the range of 200 to 4000 Hz, a natural frequency $f_0$ of 1000 Hz and a high frequency which is an integral multiple thereof can be particularly observed. By contrast, the structure of the present invention with a plurality of supporting sections 113 provided at predetermined intervals, makes it possible to shift a high-frequency zone to 800 to 9000 Hz, and the natural frequency $f_0$ is approximately 5200 Hz and reduced in sound pressure. As is generally known, the sound frequency range audible to the human ear is from 20 to 20000 Hz. The range of 300 to 4000 Hz is said to be particularly audible. Thus, in the illumination using an inorganic EL material according to the present invention, it is possible to change the frequency of the acoustic noise involved to a frequency almost inaudible to the human ear.

In the following more specific example, the specifications of the conductor 124 as a single unit are set as follows: the outer diameter: ϕ4 mm, and the operational force: 1.3 N. The supporting sections 113 are arranged at the four corners with respect to the switch button 125, and include two columnar ones at the lower right and left corners, and two elliptical ones at the upper right and left corners. The protruding part 112 has an upper surface diameter of ϕ1.5 mm, and the upper surface diameter Y2 of the supporting sections 113 and the vertical width Y2 of the supporting sections 113' are set to 1.35 mm. The dimension of the upper surface end portion R2 of the supporting sections 113 is 0.3 mm, and the dimension of the end portion R1 of the protruding part upper surface is 0.3 mm. The circular supporting sections 113 and the elliptical supporting sections 113' both have a height Y2 of 0.35 mm, the protruding part 112 has a height of 0.3 mm, and hence the difference in height between the supporting sections 113 and the protruding part 112 is 0.05 mm. The height of the supporting sections 113' is the same as that of the supporting sections 113. The supporting sections 113 and 113' have laterally adjacent steps Y4, the dimension of which is 0.08 mm.

The above-mentioned dimensional relationship is optimized according to the combination of the frequency adjustment, the design of the configuration of the switch button 125, and the materials, thickness, etc. of the members. Thus, the present invention should not be restricted to the above-mentioned values.

Further, the conventional structure, which provides illumination by using organic EL material (OLED), is very vulnerable to the pressure due to key depression. Thus, with organic EL, the wiring patterns and the illuminating portion cannot be arranged in the same region. Thus, the wiring patterns and the illuminating portion are arranged in regions separate from each other in the planar direction. With this structure, the entire surface of the switch button can not be illuminated. According to the present invention, an inorganic EL material formed of a polymer type material is used and this structure makes it possible to realize a luminous sheet that is very resistant to external pressures. Accordingly, the wiring patterns and the illuminating portions can be arranged in the same region in the planar direction.

Further, due to the provision of the supporting sections 113, an appropriate adjustment is made so as to avoid extreme deflection of the switch sheet 102 at the time of click operation. Through deflection to an appropriate degree, the impact of the deflection of the conductor 124 is reduced, making it possible to reduce the click sound.

Figure 17:
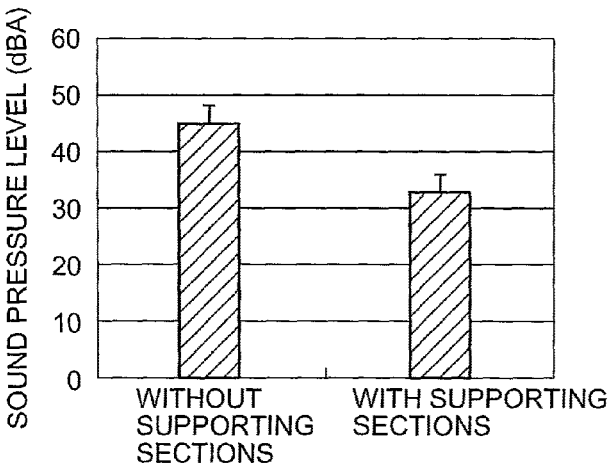
FIG. 17 is a graph showing click sound of a luminous switch according to the present invention.

FIG. 17 shows an example of data indicating the difference in click sound between the case in which the supporting sections 113 are provided and the case in which the supporting sections 113 are not provided. In an anechoic room of a background noise of 20 dB(A) or less, an ordinary noise meter was installed 10 mm above the switch button 125, and the click sound was measured. The click sound, which is 45 dB(A) in the conventional structure without the supporting sections 113, is reduced to 32 dB(A) in the structure of the present invention. This shows that the structure according to the present invention is effective in reducing the click sound.

Second Embodiment

Figure 8:
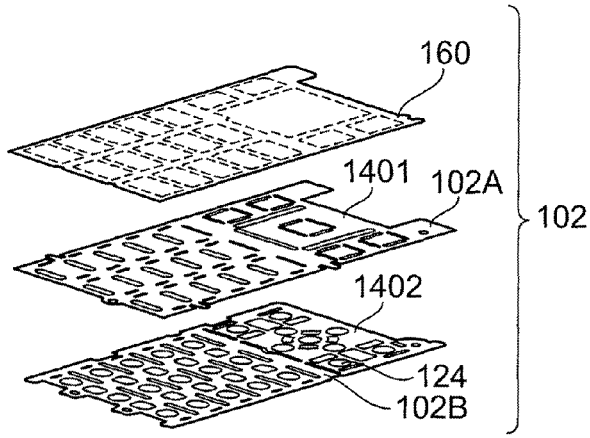
FIG. 8 is an exploded perspective view of a switch sheet of a luminous switch according to a second embodiment of the present invention.

Next, a second embodiment would be described. FIG. 8 is an exploded perspective view of the switch sheet 102 of a luminous switch according to the second embodiment of the present invention. The second embodiment differs from the first embodiment in that the luminous sheet 160, the wiring sheet 102A, and the cover sheet 102B are integrated by gluing them to each other.

Figure 14:
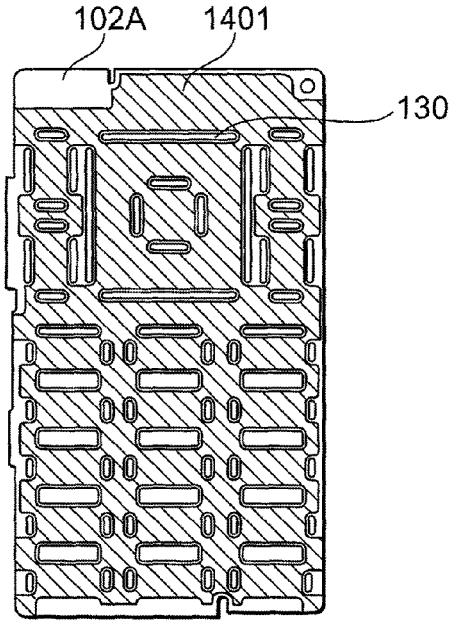
FIG. 14 is a plan view of an adhesive material of a wiring sheet of a luminous switch according to the present invention.
Figure 15:
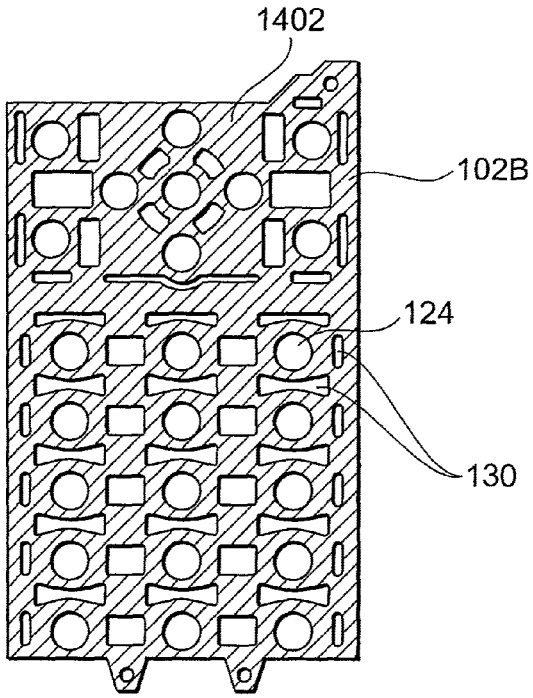
FIG. 15 is a plan view of a cover sheet of a luminous switch according to the present invention.

More specifically, as shown in FIGS. 8 and 14, an adhesive material 1401 is provided on the luminous sheet 160 side surface of the wiring sheet 102A. Further, as shown in FIG. 14, the adhesive material 1401 is provided substantially all over one surface of the wiring sheet 102A. On the other hand, as shown in FIG. 15, an adhesive material 1402 is provided on the wiring sheet 102A side surface of the cover sheet 102B, and the adhesive material 1402 is also provided substantially all over one surface of the wiring sheet 102B. As described above, the adhesive materials 1401 and 1402, which are provided substantially all over the entire surfaces, are attached to each other, whereby oscillation of the sheets at the time of illumination drive by the inorganic EL material is suppressed. The luminous sheet 160 and the sheets around the same cease to rise, and no oscillation is caused to occur through excitation. Further, through integration by attaching to each other two kinds of adjacent sheets other than the luminous sheet 160, the mass is increased by approximately three times. As a result, the amplitude is suppressed, and the sound pressure is reduced.

Figure 18:
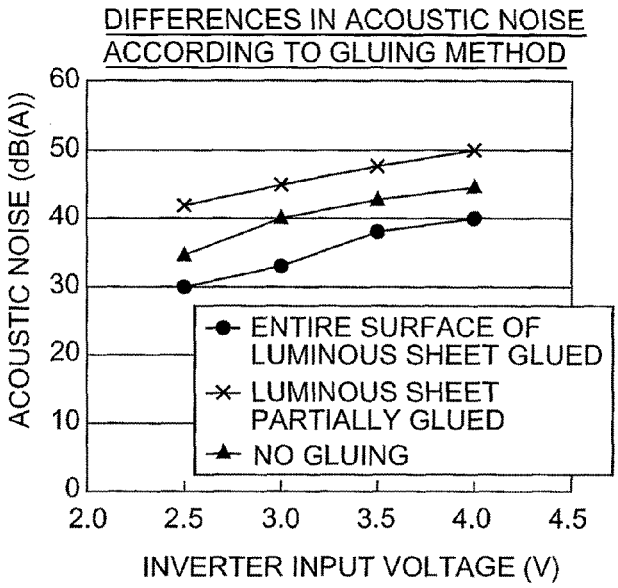
FIG. 18 is a graph showing an example of acoustic noise of a luminous sheet of a luminous switch according to the present invention.

FIG. 18 shows an example of the sound pressure (acoustic noise) in this embodiment. Comparison was made between the case in which the luminous sheet 160, the wiring sheet 102A, and the cover sheet 102B are not glued together but simply superimposed one on the other and the case in which substantially the entire surfaces of those sheets are glued to each other. When the voltage input to the drive circuit 161 (inverter input voltage) was 2.5 V, the acoustic noise in the former case was 40 dB(A), whereas the acoustic noise in the latter case was 32 dB(A), which means a noise reduction by 12 dB(A). It was clear from the experiment as shown in FIG. 18 that, as compared with the case in which substantially the entire surfaces of the sheets are glued together, the sound pressure suppression effect in the case in which the area of the sheets glued together is approximately ½, that is, the gluing is effected only partially, is rather inferior.

The method of fixation for the luminous sheet 160, the wiring sheet 102A, and the cover sheet 102B is not restricted to gluing. It is also possible to adopt a fixation method using an adhesive material, an adhesive sheet or the like. Further, although not shown in the drawings, the surfaces on which the adhesive material is provided may also be the luminous sheet 160 side.

Third Embodiment

Figure 9:
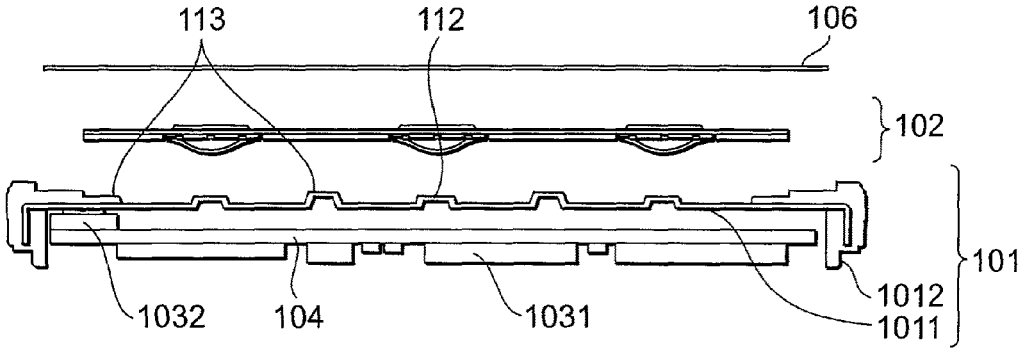
FIG. 9 is an exploded sectional view of a luminous switch according to a third embodiment of the present invention.

Next, a third embodiment would be described. FIG. 9 is an exploded sectional view of the structure 101 of a luminous switch according to the third embodiment of the present invention. The third embodiment differs from the first embodiment in that the region of the structure 101 for the protruding parts 112 and the supporting sections 113 is formed of metal, and the peripheral region thereof is formed of resin.

More specifically, a first casing 1011 is first formed of metal, and then the first casing 1011 is installed in another mold, into which resin is poured to form a second casing 1012, whereby the first casing 1011 and the second casing 1012 are integrally molded. In this case, the first casing 1011 is formed by press molding of sheet metal or casting of magnesium, aluminum or the like. On the other hand, the resin of the second casing 1012 is selected taking into account a plurality of factors such as strength, drop impact property, and moldability.

Instead of integrally molding the metal and the resin within a mold as described above, it is also possible to join the first and second casings 1011 and 1012 with each other by adhesion or bonding to obtain a desired configuration.

The inorganic EL material is driven by a high voltage of around AC 100 V to be illuminated, and hence electromagnetic noise is likely to be generated. This electromagnetic noise may adversely affect the operation of the peripheral electrical components. In the present invention, the region of the protruding parts 112 and the supporting sections 113 is formed of metal, and hence it is possible to shield the component on the substrate arranged below from electromagnetic noise. In particular, metal shielding is effected between an acoustic component 1032 (e.g., microphone) subject to electromagnetic noise, a wireless circuit component 1031, etc. and the luminous sheet 160, whereby it is possible to attain the effect of suppressing acoustic noise and unnecessary resonance.

Usually, shielding is carried out by using a sheet with graphite formed thereon. In the present invention, in contrast, there is no need to provide any dedicated component. This serves to achieve a reduction in the number of components and a reduction in cost. Further, in the case in which the first casing 1011 is formed of resin, the wall thickness is approximately 0.8 mm from the viewpoint of moldability and strength, whereas, in the case in which the first casing 1011 is formed of metal, it is possible to use a sheet metal of a thickness of 0.3 mm, and hence the wall thickness of the first casing 1011 can be reduced by 0.5 mm. Further, by forming the portion around the metal portion of the first casing 1011 of resin, it is possible to easily realize the complicated configuration of the component retaining portion, fit-engaging portion, etc., which are rather hard to form of metal.

The protruding parts 112 and the supporting sections 113 may also be formed of other materials and arranged on the sheet metal. For example, metal pieces and a resin material may be bonded to the sheet metal by crimping or adhesion. In this case, the heat insulating effect due to the space formation through press molding is reduced, and the number of components is increased. However, from the viewpoint of production, it is advantageous in that the complicated configuration involved in press molding is mitigated, which helps to achieve high precision in terms of flatness.

Fourth Embodiment

Next, a fourth embodiment is described. FIGS. 10, 11, 12, 13, 14, and 15 are diagrams showing the components of the fourth embodiment of the present invention. The dimensions and layout of the supporting sections 113 and the protruding parts 112 are the same as those in FIG. 7. The fourth embodiment differs from the first embodiment in that the rigidity of the luminous sheet 160, the wiring sheet 102A, and the cover sheet 102B is reduced, thereby achieving an improvement in terms of click characteristic.

Figure 10:
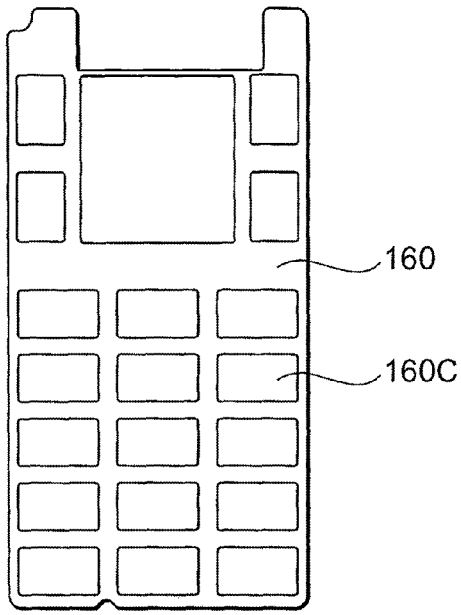
FIG. 10 is a plan view of a luminous sheet of a luminous switch according to the present invention.

More specifically, the regions of the protective layer of the luminous sheet 160 corresponding to the contour of the switch buttons are reduced in thickness. As shown in FIG. 10, the portion of the protective layer corresponding to the outer periphery of the areas forming the EL light emission layers 160C is reduced in thickness to a degree that the illumination performance is not affected. The protective layer, which has a thickness of approximately 20 μm, is reduced in thickness to approximately 10 μm, thereby achieving a reduction in rigidity. It is also effective to make the luminous sheet 160 easier to deflect by providing a slit or notch (not shown) therein to a degree that the illumination performance is not affected. In this case, it is desirable for the distance from the luminous area and the wiring patterns to the end surface of the luminous sheet 160 to be as large as possible since a fluorescent material (in particular, inorganic EL fluorescent material) is rather vulnerable to humidity.

Figure 11:
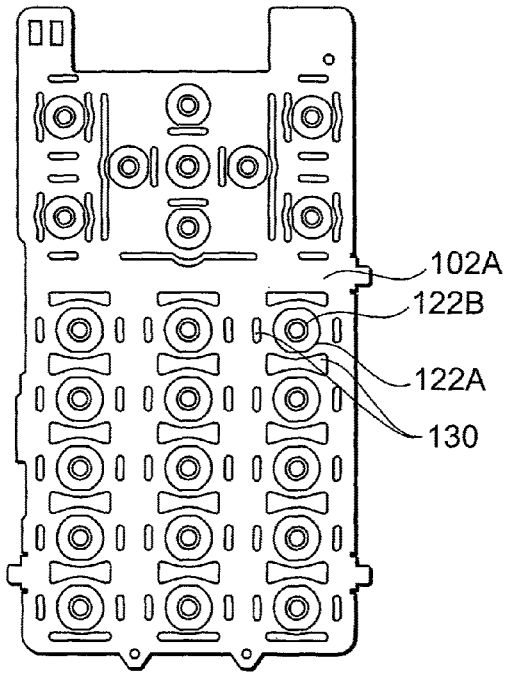
FIG. 11 is a plan view of a wiring sheet of a luminous switch according to the present invention.
Figure 12:
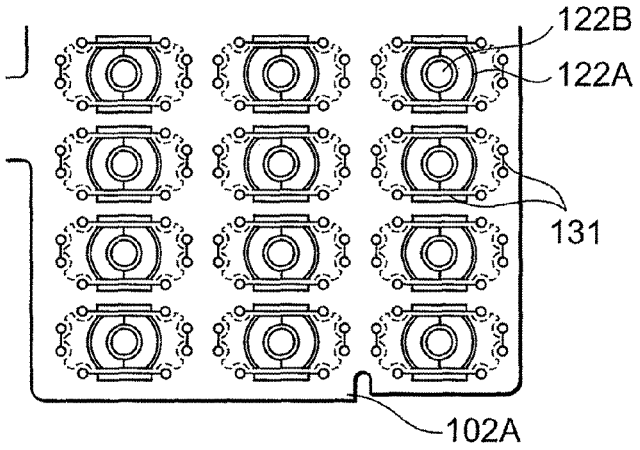
FIG. 12 is a plan view showing a notch configuration of a wiring sheet of a luminous switch according to the present invention.
Figure 13:
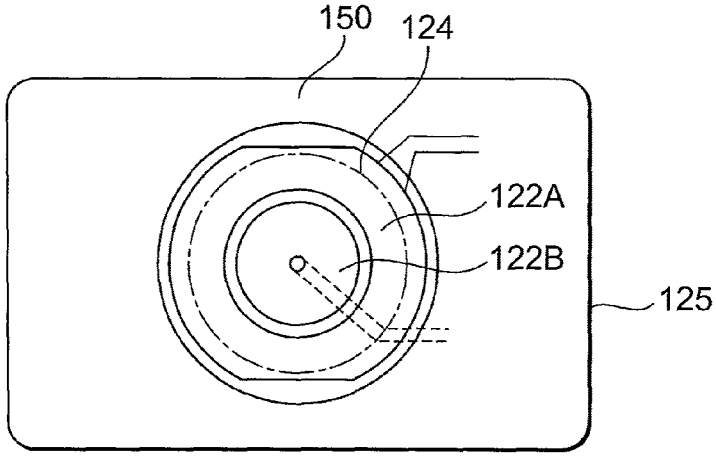
FIG. 13 is a plan view of a wiring pattern of a wiring sheet of a luminous switch according to the present invention.

Next, as shown in FIG. 11, in the wiring sheet 102A, slits 130 are provided around the wiring patterns 122A. Since the slits 130 are formed by stamping, the slit width is restricted to a minimum in consideration of mass production property. Further, since it is necessary to provide areas for routing the wiring patterns around the slits 130, it is desirable for the slit width to be as small as possible. Actually, a slit width ranging from 0.5 to 0.8 mm is suitable from the viewpoint of mass production. As shown in FIG. 12, in another example, notches 131 are provided around the wiring patterns 122A. Since there is a fear of rupture with the notches 131 alone, it is desirable to provide holes at both ends of each notch 131. In order to secure the requisite area for routing the peripheral wiring patterns, it is desirable for those holes to be as small as possible. Taking into account the mass production property, a suitable hole diameter ranges from approximately ϕ0.5 to 1.5 mm. Further, usually, from the viewpoint of securing the requisite conduction area for the conductors 124 and the wiring patterns 122A, the Cu foil surface is sometime made relatively large.

As shown in FIG. 11, the wiring patterns 122A situated coaxially with the switch buttons 125 form electrodes formed of Cu foil. The wiring patterns 122A are formed as regions somewhat larger than the contours of the conductors 124, mitigating the rigidity of the Cu foil surfaces when the switch buttons are depressed.

Next, as shown in FIG. 14, also in the cover sheet 102B, slits 130 are provided around the conductors 124, making the cover sheet 1028 easy to deflect. Instead of the slits 130, it is also possible to provide notches 131. Also regarding the cover sheet 102B, the above-mentioned recommendable dimension allowing mass production is adopted for the slits and notches formed in the wiring sheet 102A.

Figure 19:
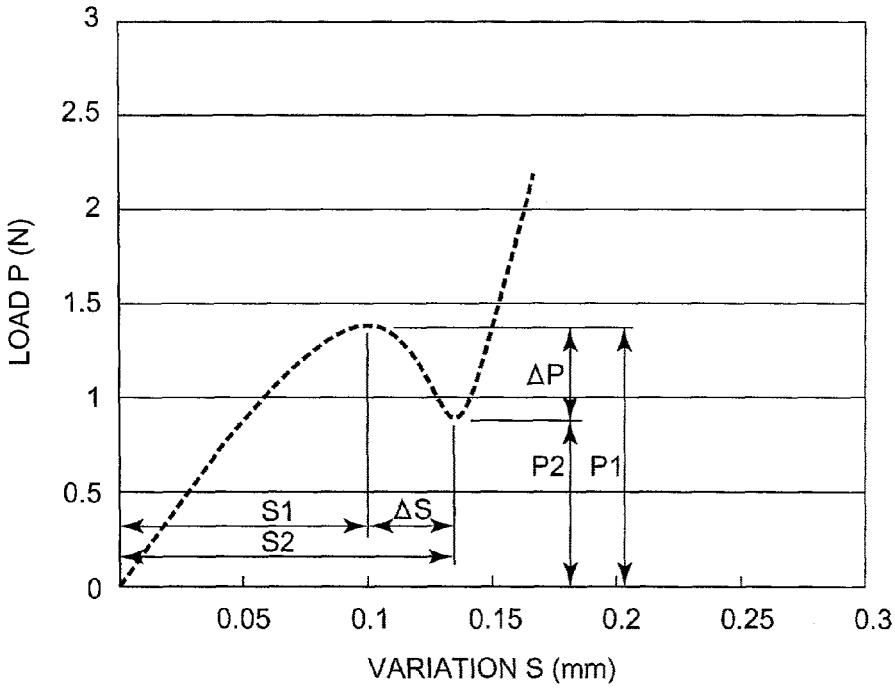
FIG. 19 is a graph showing click characteristics.

Due to the above configurations of the components, it is possible to obtain the click characteristics as shown in FIG. 19 when the switch buttons are depressed. The value of the difference ΔP between the crest P1 and the trough P2 of a load variation curve is relatively large, and the value of P2 tends to be small, thus making it possible to obtain a clear and satisfactory click characteristic. Here, the term click characteristic means the feel of the switch operation in numerical form at the time of depression and releasing of the switch. The most general parameter expressing the click characteristic is a click rate, which is calculated from the formula: ΔP/P1.

Further, the dimension and layout of the supporting sections 113 and the protruding parts 112 are described. As in the case of the switch button 125''' of FIG. 7, in the basic peripheral construction of the switch button 125, one plate forming the switch button 125 is provided for one switch function. In this case, the supporting sections 113 are arranged at the four corners of the switch button 125'''. It is necessary for the configuration of the upper surfaces of the supporting sections 113 to be selected from among circular, elliptical, and polygonal configurations. In this example, the circular and elliptical configurations are selected. The end surfaces of the upper surfaces of the supporting sections are of a rounded configuration of a predetermined curvature. In order that the contour of the protruding part 112 and the contour of the switch button may not overlap each other at least in one planar direction, a gap is provided. When the gap is small, the click characteristic is affected. In particular, it leads to a reduction in click rate and an increase in operational force. Further, the degree of the gap is directly related to the interval between the switch buttons, and hence it affects the design property. Thus, the dimension and layout of the supporting sections 113 and the protruding parts 112 are determined according to the characteristics of the material to be used and the design to be realized. The diameter and height of the protruding parts 112 influence the click characteristics of the conductors 124, in particular, the click rate and the operational force. Usually, it is desirable for the diameter of the protruding parts to be approximately 20% to 50% of the diameter of the conductor. In the case of a conductor 124 having a diameter of ϕ4 mm, the diameter of the protruding parts preferably ranges from ϕ1.5 to 2.0 mm and the height thereof ranges from 0.2 to 0.3 mm. The height of the supporting sections 113 is set to be somewhat larger than that of the protruding parts 112. When the area of the portions of the supporting sections 113 around the protrusions 112 is too large, or when the supporting sections 113 are too close to the protruding parts 112, or the height in difference between the supporting sections 113 and the protruding parts 112 is too large, the click characteristic may be adversely affected. Further, when the protruding parts 112 are higher than the supporting sections 113, malfunction of the peripheral switch buttons or deflection of the peripheral portion occurs. Thus, the layout and configuration of the supporting sections 113 are preferably optimized according to the members forming the switch section, that is, in this construction, according to the size, thickness, material, gluing configuration, etc. of the luminous sheet 160, the cover sheet 1028, the wiring sheet 1028, the conductors 124, the top cover 106, and the switch section 126.

Figure 7:
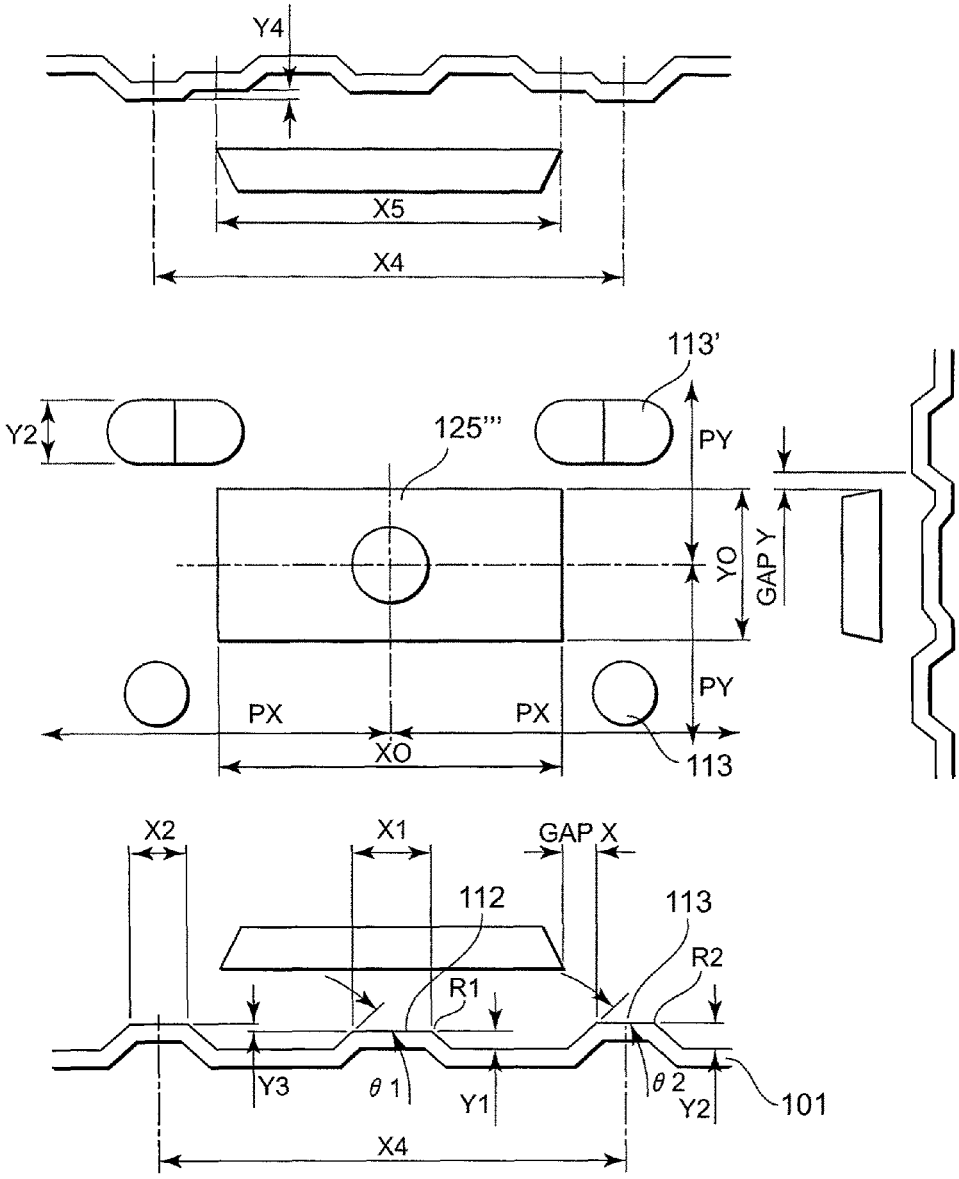
FIG. 7 is a diagram showing an example of the arrangement and dimensions of supporting sections and protruding parts in the luminous switch according to the present invention.

FIG. 7 shows a specific example of the layout and dimensional relationship. In the following example of the configuration, dimension, and layout of the protruding parts 112 and the supporting sections 113, the specifications of the conductor as a single unit are set as follows: the outer diameter: ϕ4 mm, and the operational force: 1.3 N. Here, it is assumed that the horizontal width X0 of the switch button 125''' is 9.5 mm, that the vertical width Y0 thereof is 5 mm, that the pitch PX in the horizontal direction is 12.5 mm, and that the pitch PY in the vertical direction is 7.5 mm. The supporting sections 113 are arranged at the four corners with respect to the switch button 125, and include two columnar ones at the lower right and left corners, and two elliptical ones at the upper right and left corners. The protruding part 112 has an upper surface diameter of ϕ1.5 mm, and the upper surface diameter Y2 of the supporting sections 113 and the vertical width Y2 of the supporting sections 113' are set to 1.35 mm. The dimension of the upper surface end portion R2 of the supporting sections 113 is 0.3 mm, and the dimension of the end portion R1 of the protruding part upper surface is 0.3 mm. The upper surface end portion R2 and the end portion R1 are of a rounded configuration in conformity with the configuration of the switch button and the conductor when the switch button and the conductor are deflected. The circular supporting sections 113 and the elliptical supporting sections 113' both have a height Y2 of 0.35 mm, and the protruding part 112 has a height of 0.3 mm, and hence the difference in height between the supporting sections 113 and the protruding part 112 is 0.05 mm. The height of the supporting sections 113' is the same as that of the supporting sections 113, and the supporting sections 113 and 113' have laterally adjacent steps Y4, the dimension of which is 0.08 mm. In the case of the above dimensional relationship, the horizontal gap X between the switch button 125 and the supporting sections 113 is approximately 0.8 mm, and the vertical gap Y therebetween is 0.6 mm. The click characteristic is greatly influenced by the above-mentioned gap X, the gap Y, the protruding part height Y1, the supporting section height Y2, the difference in height Y3 between the protruding part 112 and the supporting sections 113, and the configuration of the supporting section upper surfaces. Further, as is apparent from FIG. 7, it has been proved to be desirable from the viewpoint of improving the click characteristic that the distance (inner dimension) between the supporting sections 113 and 113' be larger than the width of the conductor 124 in both the vertical and horizontal directions.

The above-mentioned dimensional relationship exemplifies an index of providing a satisfactory click characteristic. Apart from this, an adjustment is also made on the kind and thickness of the components, the gluing material, and the gluing area. Regarding the above-mentioned dimensional relationship, optimum values are obtained based on a combination of the design according to the arrangement of the switch button 125, the materials of the members, and the thickness thereof. Thus, the above-mentioned values should not be construed restrictively.

Figure 20:
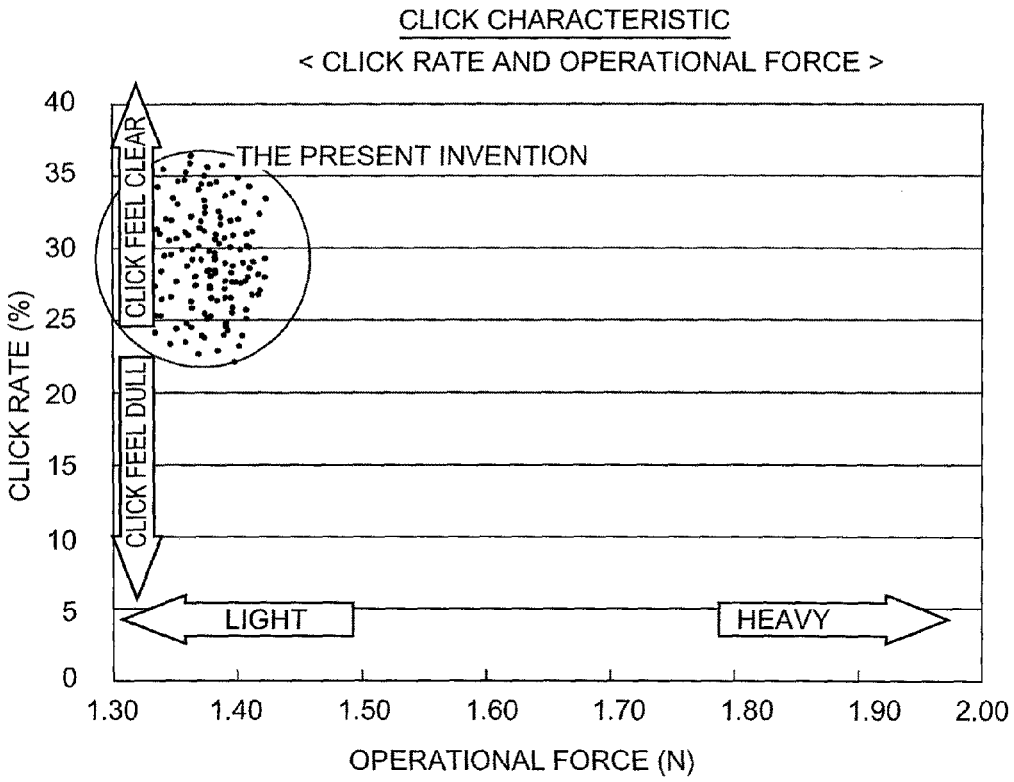
FIG. 20 is a graph showing the click characteristics of a luminous switch according to the present invention.
Figure 21:
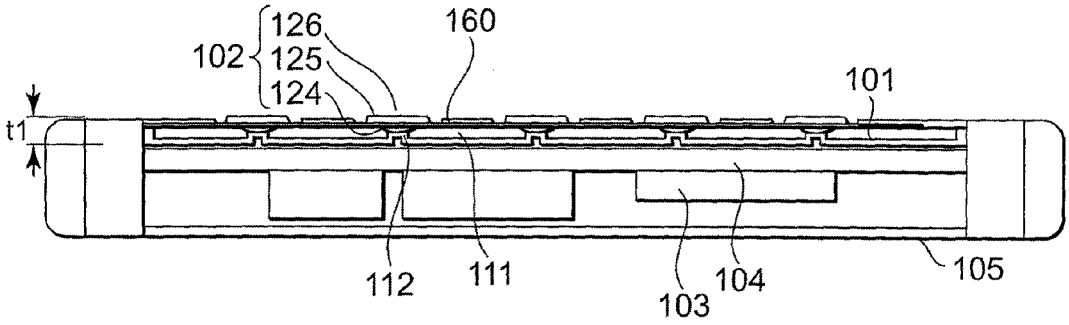
FIG. 21 is a sectional view showing an example of a conventional illumination structure.
Figure 22:
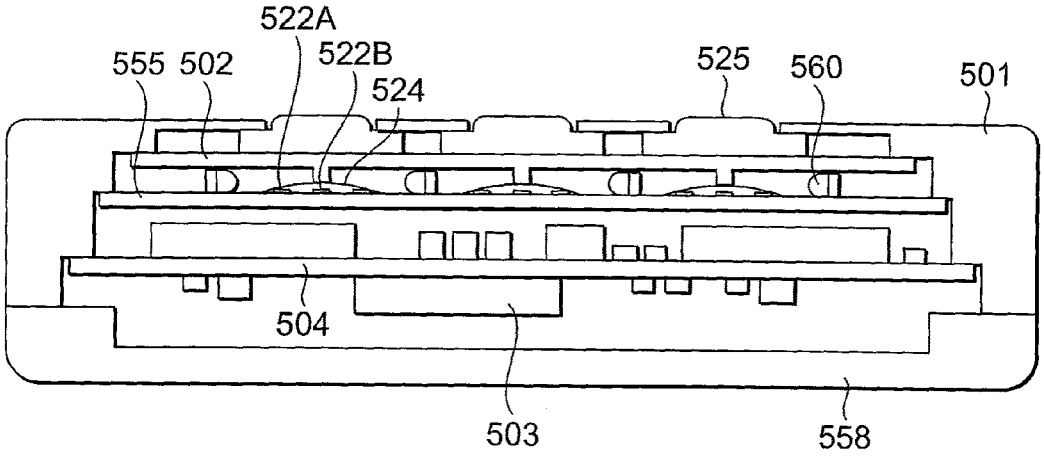
FIG. 22 is a sectional view showing another example of a conventional illumination structure.

FIG. 20 is a graph showing the click characteristic improving effect of the present invention. In the case in which the operational force of the conductor as a single unit is 1.3 N, the click rate in the illumination structure of the present invention was approximately 30%, and the operational force was approximately 1.35 N. Generally speaking, with a satisfactory click characteristic, the click rate is around 30%, and the operational force ranges approximately from 1.1 to 1.6 N. Thus, the click characteristic of the switch of the present invention is to be regarded as satisfactory. Further, due to the arrangement of the supporting sections 113, it is possible to prevent malfunction of the peripheral switch buttons 125 at the time of depression of the switch button. Further, it is also possible to maintain the flatness of the portion of the top plate 106 around the switch button 125 and to secure the rigidity thereof.

While regarding the embodiments of this specification the conductors 124 have been described, the conductors 124 may be formed by members elastically deformable at the time of depression of the switch buttons 125 to effect electrical conduction between the wiring patterns 122A and the wiring patterns 122B.

INDUSTRIAL APPLICABILITY

The luminous switch of the present invention is applicable to a mobile terminal such as a mobile phone or a PDA and an electronic device such as a personal computer, making it possible to achieve thinning and to obtain the effects as described with reference to the embodiments of the present invention.

The present invention is applicable not only to a mobile phone but also to other mobile terminals such as a PDA and an electronic device such as a personal computer.

The invention claimed is:

1. A luminous switch comprising a structure which includes:

a wiring sheet having wirings on a surface thereof;

a luminous sheet stacked on the wiring sheet; and a plurality of support sections which support the wiring sheet from a back side thereof;

wherein:

the luminous sheet comprises a light emission layer which is formed by an inorganic EL material and which effects surface light emission on a side opposite to a side directed to the wiring sheet; and wherein:

the plurality of support sections support the wiring sheet around the luminous sheet.

2. A luminous switch according to claim 1, wherein:

the wiring sheet has, on a back side, wiring patterns and an elastic member electrically connected with the wiring patterns;

wherein:

the elastic member is opposite to the light emission layer via the wiring patterns; and wherein the elastic member is accommodated between the plurality of the support sections.

3. A luminous switch according to claim 2, wherein an electrode is formed on the wiring sheet, and wherein the electrode is situated so as to be electrically connected to the elastic member at a time of deformation of the elastic member.

4. A luminous switch according to claim 2, wherein the wiring sheet has a notch or a slit around the wiring patterns.

5. A luminous switch according to claim 2, wherein the elastic member is held between the wiring sheet and a cover sheet.

6. A luminous switch according to claim 5, wherein the cover sheet has a surface which is faced to the elastic member and which is coated with an adhesive.

7. A luminous switch according to claim 2, wherein the structure has a space formed between the support sections so as to accommodate the elastic member, and wherein a protruding part is formed in the space.

8. A luminous switch according to claim 2, wherein at least two of the support sections are arranged around the elastic member.

9. A luminous switch according to claim 1, wherein the luminous sheet has a protective layer, and wherein the protective layer has a peripheral region which is located outside of a light emission region and which includes at least part having a thickness smaller than that of the light emission region.

10. A luminous switch according to claim 1, further comprising:

switch buttons provided on a surface of the luminous sheet opposite to the wiring sheet.

11. A luminous switch according to claim 10, wherein the support sections are arranged so as to support the wiring sheet at outer peripheral regions of the wiring sheet which are located outside of areas where the switch buttons are arranged.

12. A luminous switch according to claim 1, further comprising:

a top plate which covers the luminous sheet and which is provided on a surface of the luminous sheet opposite to the wiring sheet.

13. A luminous switch according to claim 1, wherein the structure is a casing.

14. A luminous switch according to claim 13, wherein the casing has a first casing and a second casing, and wherein the first casing is formed of metal.

15. An electronic device having the luminous switch according to claim 1.

* * * * *